US011420786B1

(12) United States Patent
Ansola, III

(10) Patent No.: US 11,420,786 B1
(45) Date of Patent: Aug. 23, 2022

(54) FOLDABLE DRINK CUP CARRIER

(71) Applicant: Gravity Coffee Company LLC, Pacific, WA (US)

(72) Inventor: Maximo Ansola, III, Pacific, WA (US)

(73) Assignee: Gravity Coffee Company LLC, Pacific, WA (US)

( * ) Notice: Subject to any disclaimer, the term of this patent is extended or adjusted under 35 U.S.C. 154(b) by 0 days.

(21) Appl. No.: 17/554,492

(22) Filed: Dec. 17, 2021

Related U.S. Application Data

(63) Continuation-in-part of application No. 29/816,776, filed on Nov. 24, 2021, and a continuation-in-part of application No. 29/816,779, filed on Nov. 24, 2021, and a continuation-in-part of application No. 29/816,777, filed on Nov. 24, 2021.

(51) Int. Cl.
*B65D 5/50* (2006.01)
*B65D 71/62* (2006.01)

(52) U.S. Cl.
CPC ..... *B65D 5/5038* (2013.01); *B65D 5/5061* (2013.01); *B65D 71/004* (2013.01)

(58) Field of Classification Search
CPC .. B65D 5/5038; B65D 5/5035; B65D 5/5061; B65D 5/5059; B65D 5/50; B65D 71/42; B65D 71/46; B65D 71/40; B65D 71/48; B65D 71/72; B65D 71/70; B65D 71/50; B65D 2571/00444; B65D 2571/0066; B65D 2571/00654
See application file for complete search history.

(56) References Cited

U.S. PATENT DOCUMENTS

| | | | | |
|---|---|---|---|---|
| 3,868,140 | A | 2/1975 | Gordon | |
| 4,706,814 | A | 11/1987 | Baugus et al. | |
| 5,358,116 | A | 10/1994 | Brintazzoli | |
| 6,059,099 | A * | 5/2000 | Galbierz | B65D 71/42 206/151 |
| 6,168,012 | B1 * | 1/2001 | Galbierz | B65D 71/46 206/153 |
| 6,702,115 | B1 * | 3/2004 | Roper | B65D 5/5071 206/427 |
| D871,924 | S * | 1/2020 | Vanderwell | D9/755 |
| D881,021 | S * | 4/2020 | Bandinu | D9/755 |

(Continued)

FOREIGN PATENT DOCUMENTS

DE 20 2014 105 081 U1 3/2016

OTHER PUBLICATIONS

"Corrugated Cardboard Box Coffee Drink 2 4 Cup Holder Tray Cup Carrier Paper Cup Holders," [<https://www.alibaba.com/productdetail/Corrugated-Cardboard-Box-Coffee-Drink-2_1600102983880.html>, retrieved Sep. 8, 2021], 1 page.

(Continued)

*Primary Examiner* — Javier A Pagan
(74) *Attorney, Agent, or Firm* — Seed Intellectual Property Law Group LLP

(57) ABSTRACT

A foldable drink cup holder that holds up to a dozen or more beverage cups as well as straws, and provides multiple layers of horizontal stabilization for the cups in addition to providing large footprints for text and graphics, including angled and square-cut corners structured to abut against each other when the holder is in a folded configuration to provide a flat side that is rigid and stable when holding multiple filled drink cups and straws.

14 Claims, 14 Drawing Sheets

(56) References Cited

U.S. PATENT DOCUMENTS

| | | | | |
|---|---|---|---|---|
| 2006/0278559 | A1* | 12/2006 | Hamblin | B65D 71/72 206/562 |
| 2009/0242717 | A1 | 10/2009 | Stonehouse | |
| 2019/0177031 | A1* | 6/2019 | Vanderwell | B65D 5/5038 |

OTHER PUBLICATIONS

"Customized Print Hot Drink Takeaway Cups Carrier Foldable Paper Cup Holder Tray," OOLIMAPACK, [https://www.alibaba.com/productdetail/Cups-Paper-Cup-Holder-Customized-Print_1600181217480.html?spm=a2700.7724857.topad_classic.d_title.143911e7JTGzP4>, retrieved Sep. 8, 2021], 1 page.

* cited by examiner

FOLDABLE DRINK CUP CARRIER

BACKGROUND

Technical Field

The present disclosure is directed to holders designed to accommodate one or more beverage cups and, more particularly, to a portable custom cup carrier that holds up to a dozen or more beverage cups as well as straws, and provides multiple layers of horizontal stabilization for the cups in addition to providing large footprints for text and graphics.

Description of the Related Art

Many consumers purchase carry-out beverages that are intended to be consumed at a location remote from the point of purchase, such as in moving vehicles, at the office, home, and elsewhere. When multiple drinks are purchased by one consumer on behalf of others who are not present, the issue for the consumer is how to carry more than two beverage cups at one time.

Cup holders have been developed that are light-weight, disposable, and provide minimal support for the cups. They are typically composed of molded pulp that easily weakens when it becomes wet. Raised rings are formed on a flat base to receive the bottom of a cup, and these rings are restricted to one-size-fits all. The raised rings provide little to no horizontal support for the cups, allowing the cups to easily tip over when subjected to a lateral load, such as when the carrier is handed to the consumer through a window, or when a vehicle goes around a corner. No accommodation is made for holding straws, which typically accompany a disposable beverage cup, and these cup holders lack handles.

BRIEF SUMMARY

The present disclosure is directed to a custom foldable drink cup carrier is provided that addresses the foregoing deficiencies in current cup holders.

In accordance with one aspect of the present disclosure, a foldable carrier is provided for drink cups that includes:

- a single sheet of foldable material that is formed to comprise:
  - a top panel having a front bend line, a rear bend line, a right bend line, and a left bend line, the top panel having a plurality of drink cup openings;
  - a front panel extending from the front bend line on the top panel;
  - a rear panel flap extending from the rear bend line on the top panel;
  - a right side exterior flap extending from the bottom right side bend line on the top panel;
  - a left side exterior flap extending from the bottom left bend line on the top panel;
  - a bottom panel having a bottom front bend line, a bottom rear bend line, a bottom right bend line, and a bottom left bend line, the bottom panel extending from the front panel at the bottom front bend line;
  - a right side interior flap extending from the right bend line on the bottom panel;
  - a left side interior flap extending from the left bend line on the bottom panel;
  - a rear support panel extending from the bottom rear bend line on the bottom panel;
  - a middle panel having a middle front bend line, a middle rear bend line, a middle right side bend line, and a middle left side bend line, the middle panel extending from the rear support panel at the middle front bend line, the middle panel having a plurality of drink cup openings;
  - a front support flap extending from the middle rear bend line on the middle panel;
  - a right side support flap extending from the middle right side bend line on the middle panel;
  - a left side support flap extending from the middle left bend line on the middle panel; and
- the middle panel structured to fold over the bottom panel in a folded over configuration and be supported at a middle level on the bottom panel by the front support flap, the rear support panel, the right side support flap, and the left side support flap; and
- the top panel structured to fold over the middle panel and be supported on the bottom panel at a top level above the middle level of the middle panel by the front panel, the rear panel flap, the right side exterior flap, and the left side exterior flap, to place the foldable carrier in a folded configuration in which the plurality of drink cup openings in the top panel are positioned in concentric alignment with the plurality of drink cup openings in the middle panel.

In accordance with another aspect of the present disclosure, the foldable carrier includes a right back tab extending from the rear panel flap, a left back tab extending from the rear panel flap, a right back tab slit formed in the bottom rear bend line, and a left back tab slit formed in the bottom rear bend line, the left back tab and right back tab sized and shaped to be slidably received in the right back tab slit and left back tab slit, respectively, to hold the top panel in place and the foldable carrier in the folded configuration.

In accordance with yet another aspect of the present disclosure, the foldable carrier further includes a left side tab slit formed in a left side bottom bend line on the bottom panel, a right side tab slit formed in a right side bottom bend line on the bottom panel, a left side tab extending from the left side exterior flap on the top panel, and a right side tab extending from the right side exterior flap, the left side tab and right side tab sized and shaped to be slidably received in the left side tab slit and the right side tab slit, respectively, to hold the top panel in place and hold the foldable carrier in the folded configuration.

In accordance with a further aspect of the present disclosure, the foldable carrier includes a top right hand hold opening formed in the right side exterior flap, a top left hand hold opening formed in the left side exterior flap, a right side hand hold opening formed in the right side interior flap, a left side hand hold opening formed in the left side interior flap, the top right hand hold opening and the right side hand hold opening structured to overlap and the top left hand hold opening and the left side hand hold opening structured to overlap when the top panel folded over the middle panel and the foldable carrier is in the folded configuration.

In accordance with still yet another aspect of the present disclosure, the foldable carrier further includes at least one opening in the top panel and at least one corresponding opening in the middle panel that are structured to be concentric when the top panel is in the folded configuration, the at least one opening in the top panel and the at least one corresponding opening the middle panel sized and shaped to accommodate a plurality of straws corresponding in number to a number of the plurality of drink cup openings in the top panel.

In accordance with another aspect of the present disclosure, the right side exterior flap has a right side angled corner edge and a left side angled corner edge, and the bottom panel has a right side front angled corner edge and a left side angled corner edge that are sized and shaped to butt against the right side angled corner edge and the left side angled corner edge, respectively, on the front panel when the top panel is folded over the middle panel and the foldable carrier is in the folded configuration. Ideally, the right side angled corner edge, the left side angled corner edge, the right side front angled corner edge, and the left side front angled corner edge are formed at a 45 degree angle to the bottom front bend line.

In accordance with another aspect of the present disclosure, the rear panel flap has a right side top angled corner edge and a left side top angled corner edge, and further wherein the right side interior flap has a right side rear angled corner edge, and the left side interior flap has a left side rear angled corner edge, the right side angled corner edge and the left side angled corner edge are sized and shaped to butt against the right side top angled corner edge and the left side top angled corner edge, respectively, when the top panel is folded over the middle panel and the foldable carrier is in the folded configuration. Ideally, the right side top angled corner edge and the left side top angled corner edge are formed at a 45-degree angle to the rear bend line, and the left side rear angled corner edge and the right side rear angled corner edge are formed at a 45-degree angle to the bottom rear bend line.

In accordance with yet another aspect of the present disclosure, the right side internal flap has a right side interior corner adjacent the right side angled corner edge and the left side internal flap has a left side interior corner adjacent the left side angled corner edge, and further wherein the front panel has a right side exterior corner adjacent the right side top angled corner edge and a left side exterior corner adjacent the left side exterior corner edge that are sized and shaped to fit within the right side interior corner and left side interior corner, respectively, when the top panel is folded over the middle panel and the foldable carrier is in the folded configuration.

In accordance with still yet another aspect of the present disclosure, the right side interior flap has a right side rear interior corner adjacent the right side rear angled corner edge and the left side interior flap has a left side rear interior corner adjacent the left side rear angled corner edge, and further wherein the rear panel flap has a right side top exterior corner adjacent the right side top angled corner edge and a left side top exterior corner adjacent the left side top angled corner edge, the right side top exterior corner and the left side top exterior corner are sized and shaped to fit within the right side rear interior corner and the left side rear interior corner when the top panel is folded over the middle panel and the foldable carrier is in the folded configuration.

As will be readily appreciated from the foregoing, the foldable beverage cup carrier of the present disclosure provides a foldable drink cup holder that is made from a single piece of high-strength cardboard, flat pack shipped, and assembled on-site. The holder has multiple horizontal levels (top, middle, and bottom) to provide stability for taller cups. The interior middle level openings have arcuate tabs scored in one and possibly two places for bending to accommodate sizing. The top level cup openings have folding tabs scored in at least two places to accommodate different diameter cups. At least one center hole is provided in the top and middle levels to hold straws. The construction is all one piece and is scored to fold into a deployed condition. Foldable tabs and corresponding openings provide secure latching when assembled and in use, as well as providing a sturdy, durable, reusable and recyclable holder. It includes surface space available to be covered in marketing text and graphics, and it is scalable for holding any number of cups, such as 2, 4, 6, 8, 10, and 12 or more cups when filled with a beverage.

BRIEF DESCRIPTION OF THE SEVERAL VIEWS OF THE DRAWINGS

The foregoing features and advantages of the present disclosure will be more readily appreciated as the same become better understood from the following detailed description when taken in conjunction with the accompanying drawings, wherein.

DETAILED DESCRIPTION

In the following description, certain specific details are set forth in order to provide a thorough understanding of various disclosed implementations. However, one skilled in the relevant art will recognize that implementations may be practiced without one or more of these specific details, or with other methods, components, materials, etc. In other instances, well-known structures or components or both associated with the manufacture of packaging, such as cardboard packaging, have not been shown or described in order to avoid unnecessarily obscuring descriptions of the representative implementations herein below.

Unless the context requires otherwise, throughout the specification and claims that follow, the word "comprise" and variations thereof, such as "comprises" and "comprising" are to be construed in an open inclusive sense, that is, as "including, but not limited to." The foregoing applies equally to the words "including" and "having."

Reference throughout this description to "one implementation" or "an implementation" means that a particular feature, structure, or characteristic described in connection with the implementation is included in at least one implementation. Thus, the appearance of the phrases "in one implementation" or "in an implementation" in various places throughout the specification are not necessarily all referring to the same implementation. Furthermore, the particular features, structures, or characteristics may be combined in any suitable manner in one or more implementations.

Figure 1:
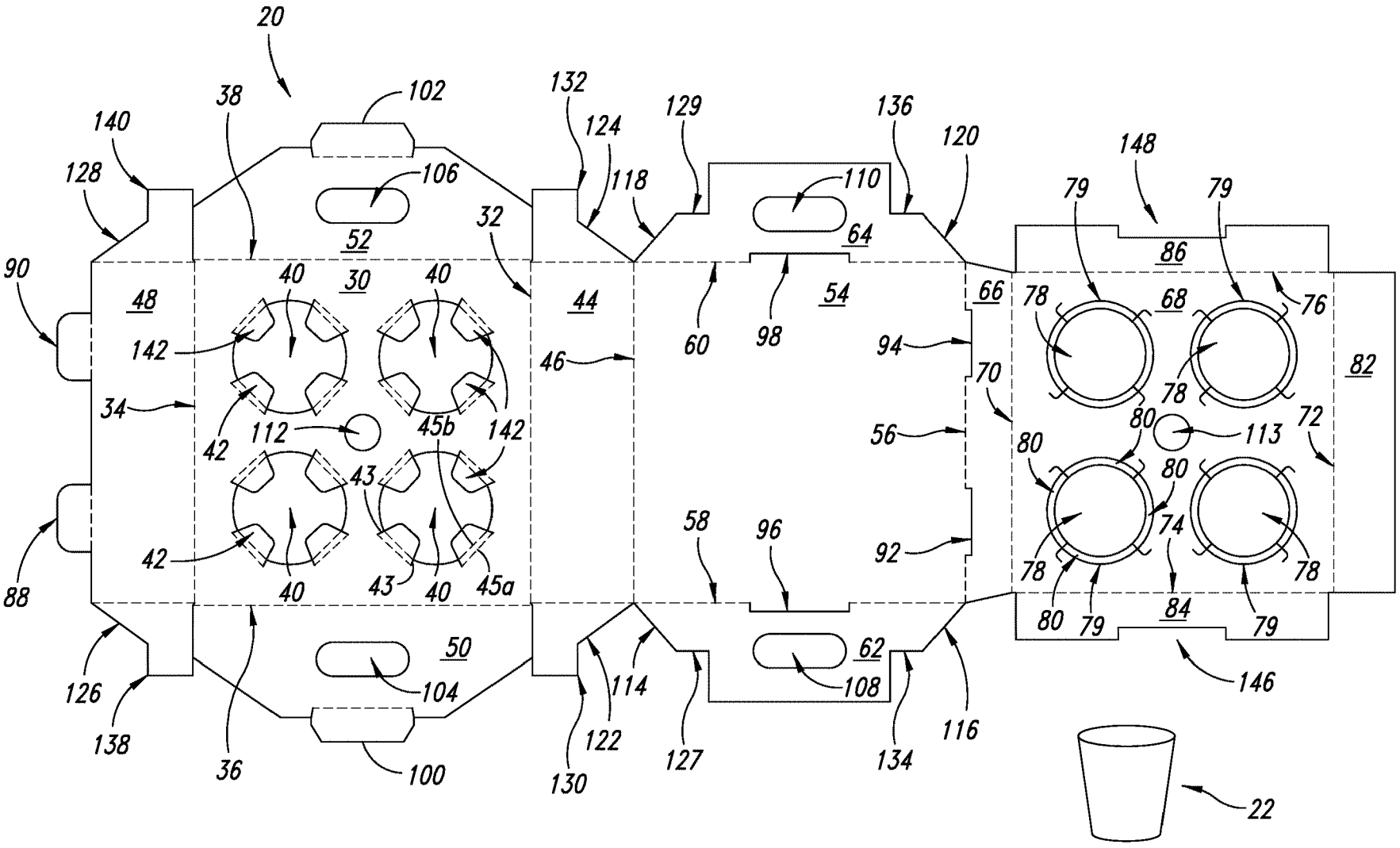
FIGS. 1-3 are top plan views of the foldable beverage cup carriers, respectively, in an unfolded, flattened configuration in accordance with the present disclosure.
Figure 2:
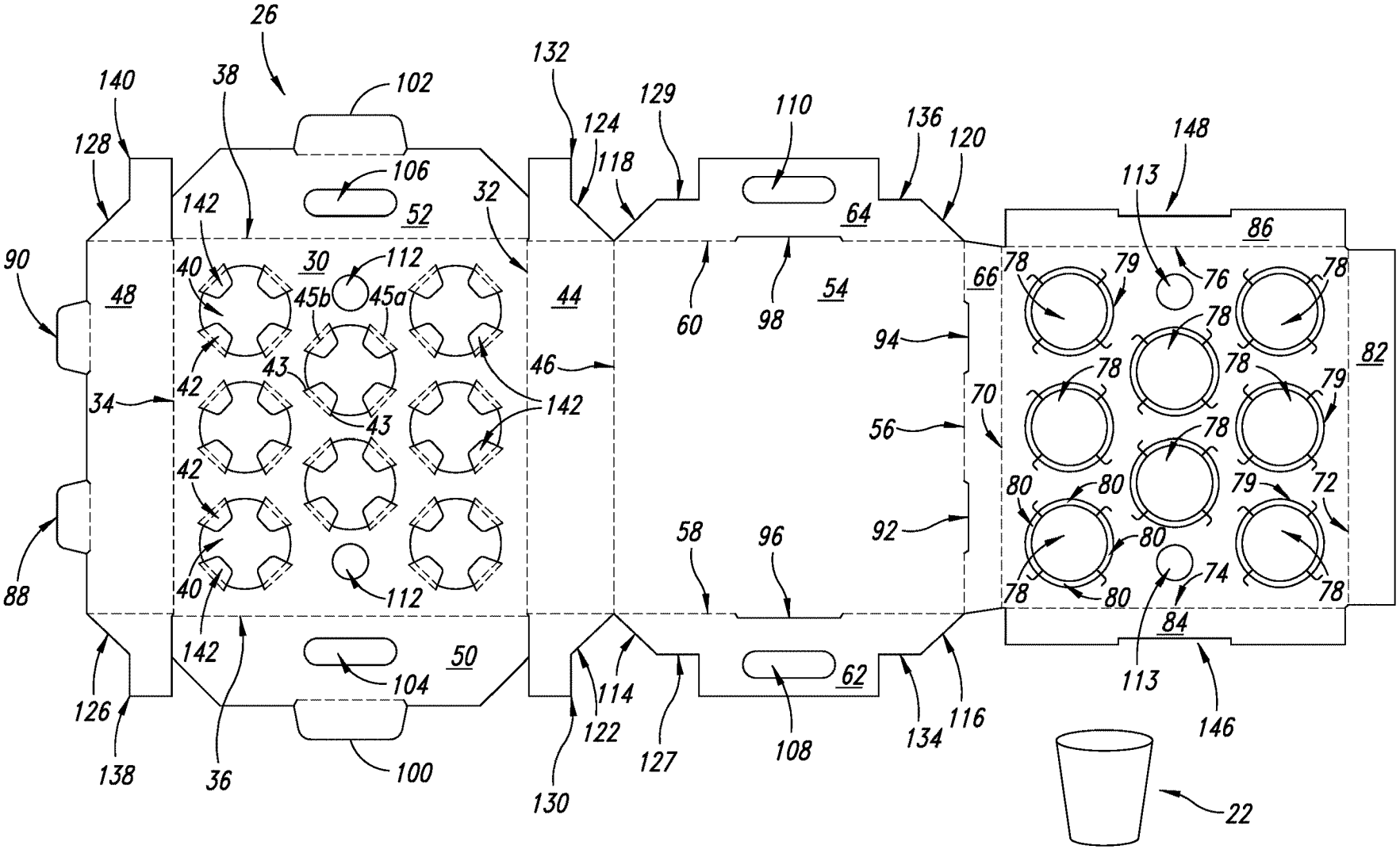
Figure 3:
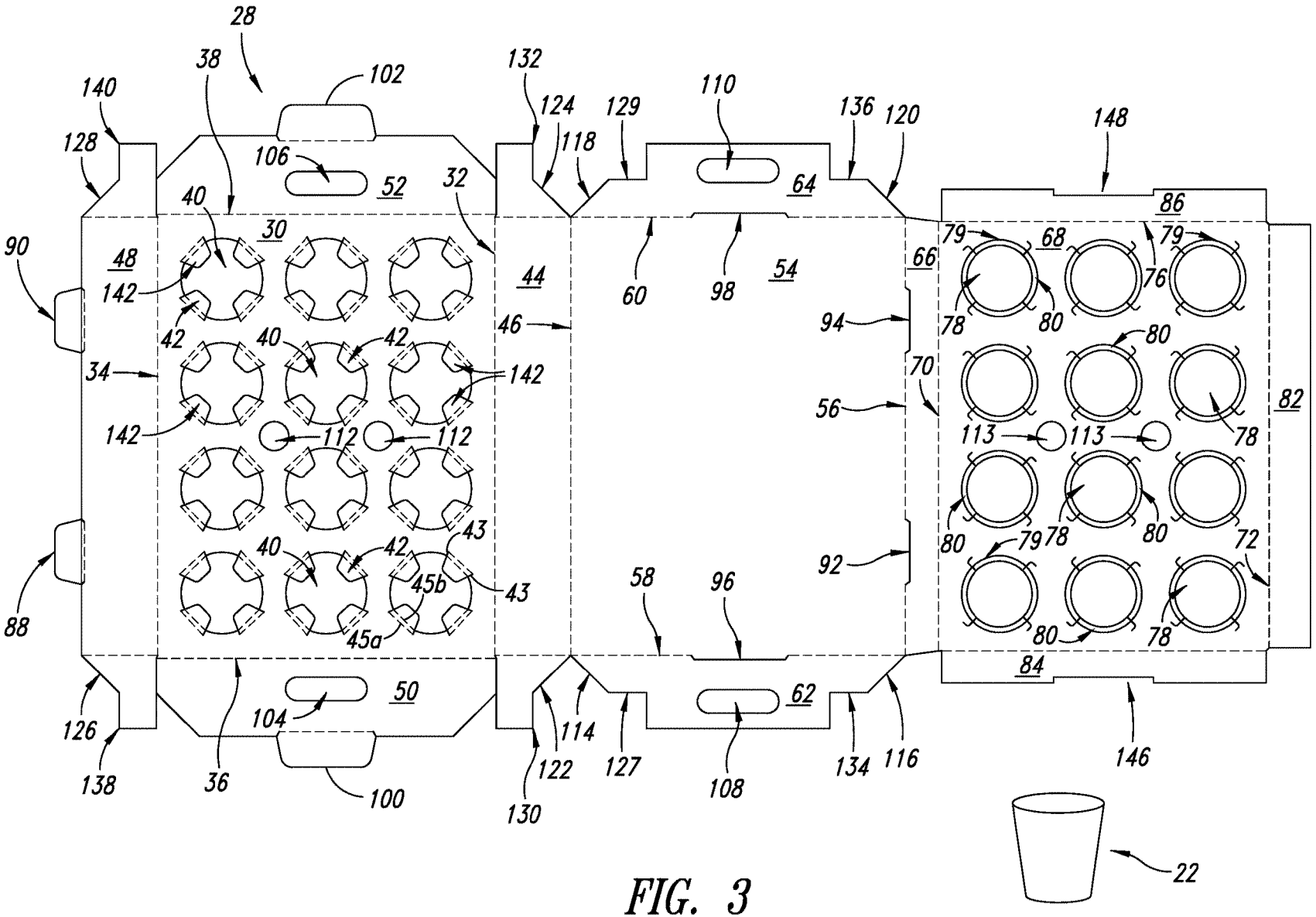
Figure 4:
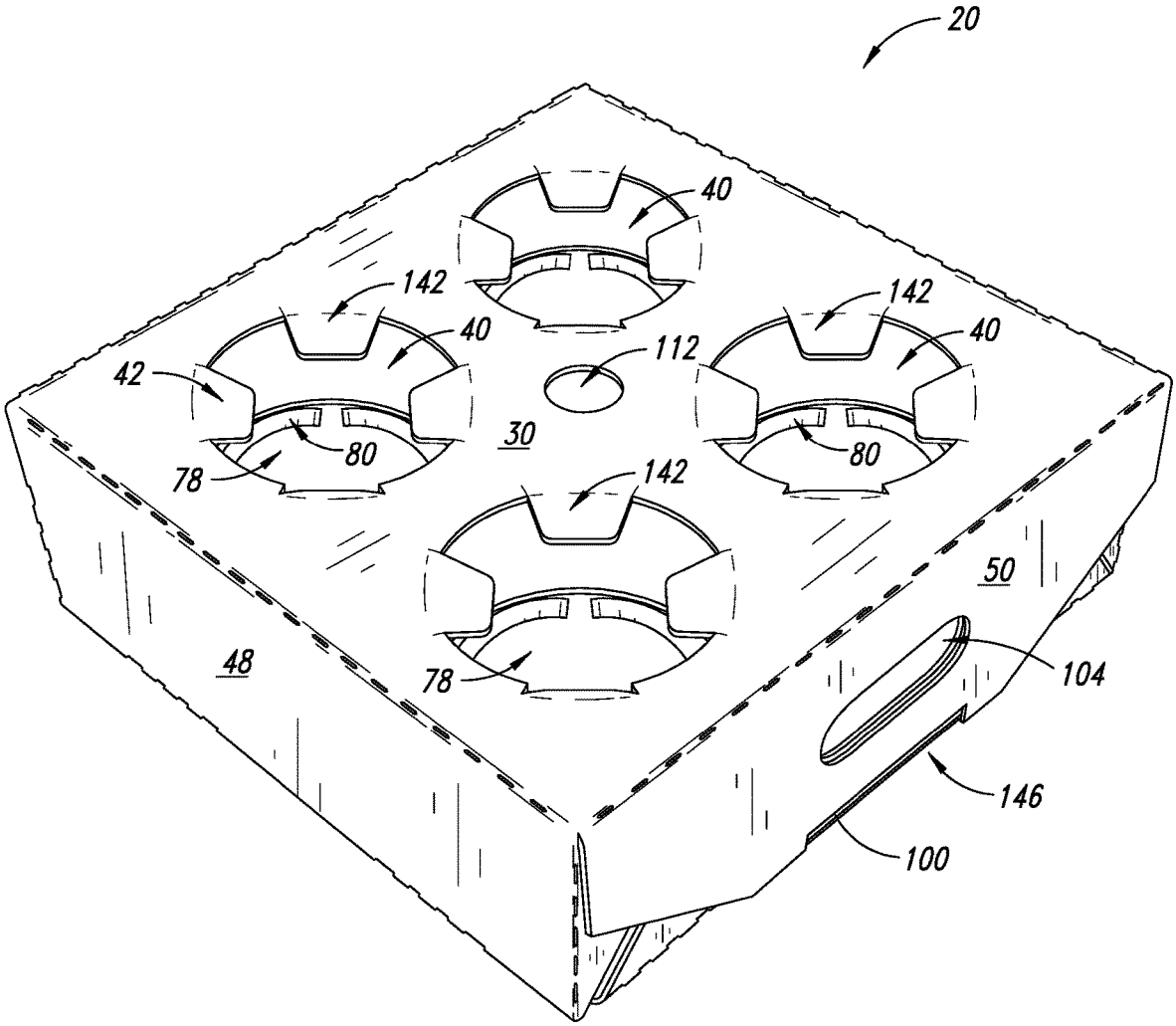
FIGS. 4-6 are axonometric illustrations of assembled foldable beverage cup carriers for four cups, eight cups, and twelve cups, respectively, in accordance with the present disclosure.
Figure 5:
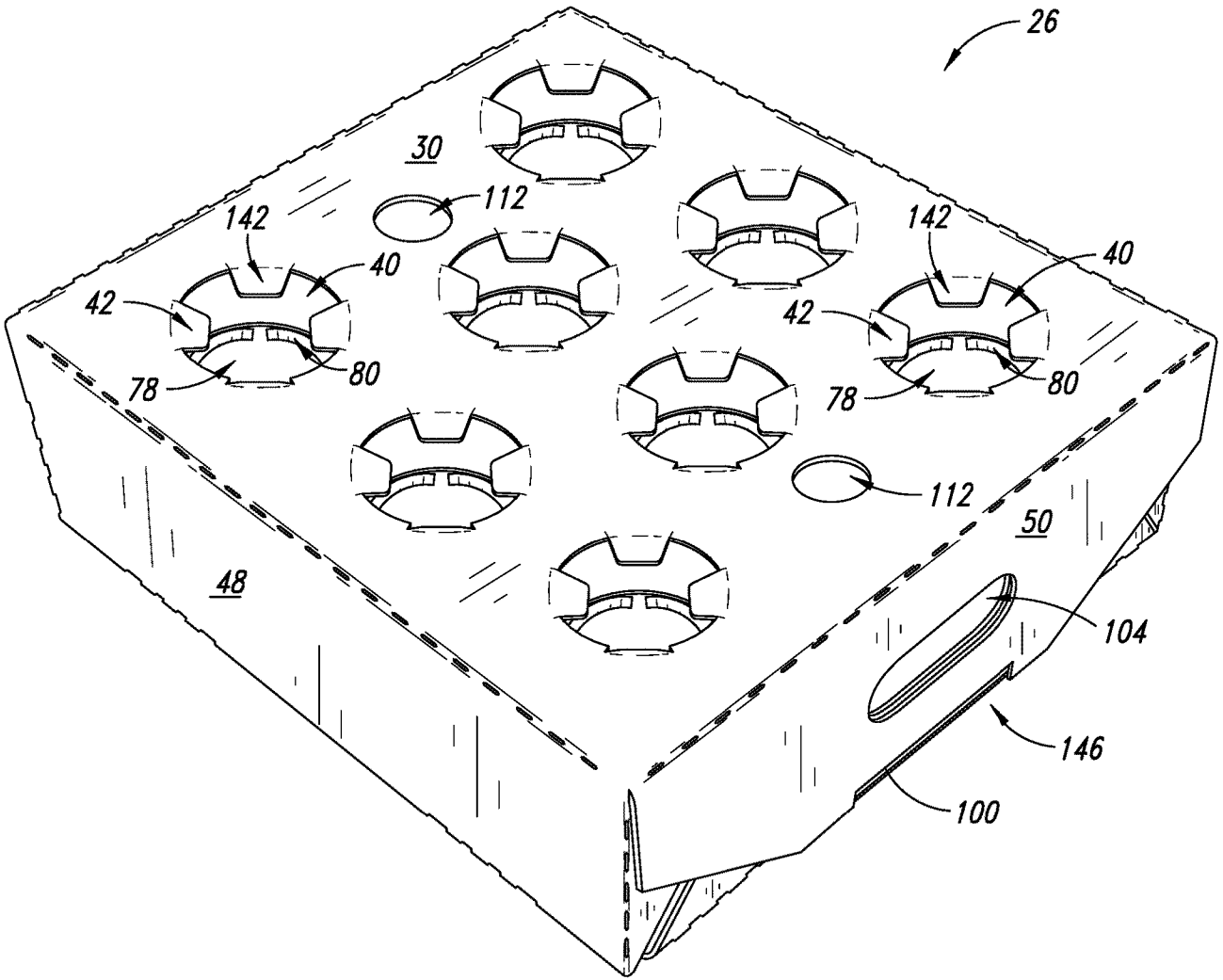
Figure 6:
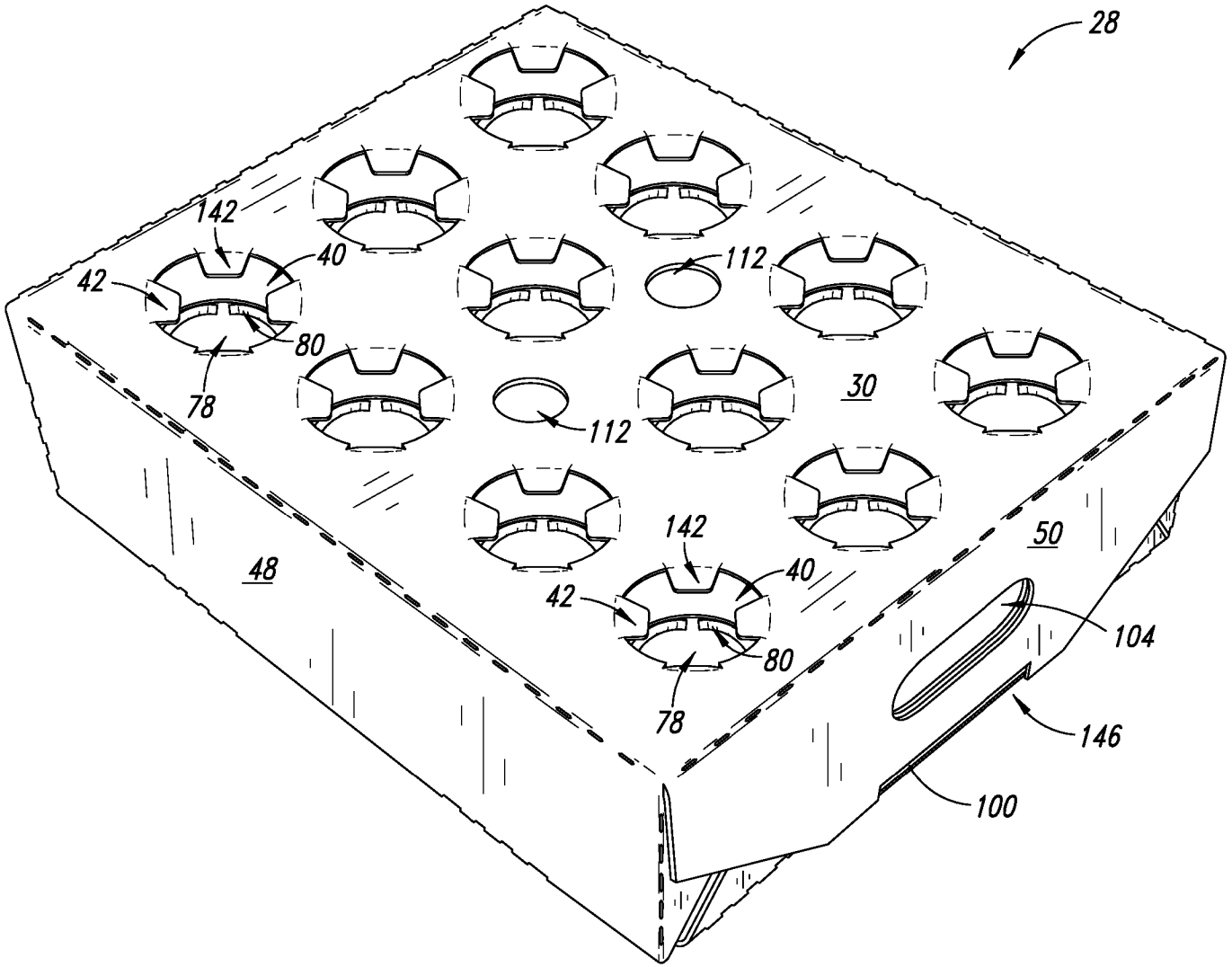

Referring to FIG. 1, shown therein is a flattened foldable carrier 20 for drink cups 22. The assembled carrier 20 is shown in FIG. 4, which in this case is a four-cup foldable drink cup carrier 20 designed to hold up to four drink cups 22 and four straws (not shown). FIGS. 2 and 3 show the eight-cup flattened foldable carrier 26 and the twelve-cup flattened foldable carrier 28, and the assembled carriers 26 and 28 are shown in FIGS. 5 and 6, respectively. Like features among these three configurations will have the same reference numbers, and the description that follows will initially focus on the four-cup carrier 20 in FIG. 1.

The carrier 20 is constructed of a single sheet of foldable material, ideally corrugated cardboard, although it may be made from plastics, composites, or other materials or combination of the same. The cardboard is die cut to create the flattened carrier 20. In a preferred implementation the foldable four-cup drink cup carrier 20 has nominal dimensions of 10 inches wide by 10 inches long and 3¼ inches high. The carrier 20 includes the following components.

A top panel 30 is shown having a front bend line 32, a rear bend line 34, a right bend line 36, and a left bend line 38. The top panel 30 has a plurality of drink cup openings 40, each opening 40 having a plurality of bendable tabs 42 arranged around the circumference of the opening 40. In this representative embodiment, the opening 40 has a diameter of 3⅜ inches, although that diameter may vary according to intended use. There are four tabs 42 spaced equidistantly around the circumference of each opening 40, with each tab 42 tabs projecting inward to form an inner diameter around the four tabs of 2 inches. This sizing is applied to each of the three carriers 20, 26, 28 described herein. Each tab 42 has two side cuts 43 into the top panel 30 that facilitate bending of the tab 42 into an interior of the carrier 20. There are also two sets of parallel transverse score lines 45*a*, 45*b* on the top and bottom surfaces of where the tab 42 joins the top panel 30. The first set of score lines 45*a* is at the end of the side cuts 43, and the second set of parallel score lines 45*b* is interior to the first set relative to the opening 40. All score lines 45*a*, 45*b*, are about ¼ inch long and are spaced about 3/16 inch from adjacent parallel score lines, both laterally and longitudinally. Again, these dimensions can vary according to intended use.

A front panel 44 is shown extending from the front bend line 32 on the top panel 30, the front panel 44 having a bottom front bend line 46. A rear panel flap 48 extends from the rear bend line 34 on the top panel 30. A right side exterior flap 50 extends from the right side bend line 36 and a left side exterior flap 52 extends from the left bend line 38 on the top panel 30.

A bottom panel 54 is provided that extends from the front panel 44 at the bottom front bend line 46, and includes a bottom rear bend line 56, a bottom right bend line 58, and a bottom left bend line 60. A right side interior flap 62 extends from the right side bend line 58 on the bottom panel 54, and a left side interior flap 64 extends from the left side bend line 60 on the bottom panel 54.

A rear support panel 66 extends from the bottom rear bend line 56 on the bottom panel 54.

A middle panel 68 extends from the rear support panel 66 at a middle front bend line 70, and it includes a middle rear bend line 72, a middle right side bend line 74, and a middle left side bend line 76. The middle panel 68 includes a plurality of drink cup openings 78, in this case four drink cup openings 78 that each have a diameter and a plurality of arcuate bendable tabs 80, in this case 4 tabs 80, extending from the circumference of the opening 78. The middle level openings are 2¾ inch inside diameter and 3¼ inch outside diameter, with four arcuate tabs 80 sized and shaped to extend completely around the circumference of the opening 78. Each arcuate tab 80 has a width of ¼ inch. The arcuate tabs 80 are attached to the middle panel 68 by a ¼ wide attachment section 79.

A front support flap 82 extends from the middle rear bend line 72 on the middle panel 68. A right side support flap 84 extends from the middle right side bend line 74 and a left side support flap 86 extending from the middle left bend line 76 on the middle panel 68.

The middle panel 68 is structured to fold over the bottom panel 54 in a folded over configuration and be supported at a middle level on the bottom panel 54 by the front support flap 82, the rear support panel 66, the right side support flap 84, and the left side support flap 86.

The top panel 30 is structured to fold over the middle panel 68 and be supported on the bottom panel 54 by the front panel 44, the rear panel flap 48, the right side exterior flap 50, and the left side exterior flap 52, at a top level that is above the middle level of the middle panel 68. The enables placing the foldable carrier 20 in a folded configuration as shown in FIG. 4 in which the plurality of drink cup openings 40 in the top panel 30 are positioned in concentric alignment with the plurality of drink cup openings 78 in the middle panel 68.

The foldable carrier 20 further includes a right back tab 88 extending from the rear panel flap 48, a left back tab 90 extending from the rear panel flap 48, a right back tab slit 92 formed in the bottom rear bend line 56, and a left back tab slit 94 formed in the bottom rear bend line 56. The right back tab 88 and left back tab 90 are sized and shaped to be slidably received in the right back tab slit 92 and left back tab slit 94, respectively, to hold the top panel 30 in place and the foldable carrier 20 in the folded configuration. Both slits 92, 94 are preferably formed to be positioned slightly off the rear bend line 56 and into the rear support panel 66 to accommodate the thickness of the tabs 88, 90. This makes it easier to assemble the carrier 20 and creates a squarer appearance when the carrier 20 is in its folded configuration. In the four-cup carrier 20, these right and left back tabs 88, 90 are about 2 inches wide and 1 inch deep and are not tapered but have rounded corners. The corresponding right and left back tab slits 92, 94 are 2 1/16 inches wide. In the eight-cup carrier 26 and twelve-cup carrier 28, these corresponding back tabs are 2½ inches wide and 1½ inch deep and taper to 2¼ inches wide with rounded corners. The corresponding slits are 3¾ inches wide.

The foldable carrier 20 also includes a right side tab slit 96 formed in the right side bottom bend line 58 on the bottom panel 54, a right side tab slit 96 formed in the right side bottom bend line 60 on the bottom panel 54, a right side tab 100 extending from the right exterior side flap 50 on the top panel 30, and a left side tab 102 extending from the left exterior side flap 52. The right side tab 100 and left side tab 102 are sized and shaped to be slidably received in the right side tab slit 96 and the left side tab slit 98, respectively, to hold the top panel 30 in place and hold the foldable carrier 20 in the folded configuration. Ideally the right side tab slit 96 and left side tab slit 98 are offset onto their respective right and left side interior flaps 62, 64 a distance sufficient to accommodate the thickness of the right and left side tabs 100, 102, to facilitate folding together of the carrier 20 and presenting a tight, square shape.

In the representative embodiment for the four-cup carrier 20, these right and left side tabs 100, 102 are about 3 inches wide and about 1 inch deep, tapering to the end with rounded corners, and the corresponding slits 96, 98 are about 3 1/16 inches wide. In the eight-cup carrier 26 and the twelve-cup carrier 28, these tabs are 4 inches and tapered to a 3¾ inch width with a depth of 1½ inches, and include rounded corners. The slits for these larger tabs are about 4⅜ inches wide.

Referring still to FIG. 1, the foldable carrier 20 further includes a top right hand hold opening 104 formed in the right side exterior flap 50, a top left hand hold opening 106 formed in the left side exterior flap 52, a right side hand hold opening 108 formed in the right side interior flap 62, and a left side hand hold opening 110 formed in the left side interior flap 64. The top right hand hold opening 104 and the right side hand hold opening 108 are structured to overlap and the top left hand hold opening 106 and the left side hand hold opening 110 are also structured to overlap when the top panel 30 is folded over the middle panel 68 and the foldable carrier 20 is in the folded configuration.

At least one straw opening 112 is formed in the top panel 30 and at least one corresponding straw opening 113 is formed in the middle panel 68 that are structured to be concentric and overlap (to be in alignment) when the top panel 30 is in the folded configuration over the middle panel 68. The straw opening 112 in the top panel 30 and the corresponding straw opening 113 in the middle panel 68 are sized and shaped to accommodate a plurality of straws, generally corresponding in number to the number of drink cup openings 40 in the top panel 30. In the representative embodiments shown herein, the straw openings 112, 113 are 1¼ inch in diameter. It is to be understood that this diameter can be increased or decreased to correspond to the number of straws to be held in place.

To facilitate the folding and maintaining of the carrier 20 in the folded configuration with the sides flat, as shown in FIG. 4, the right side interior flap 62 has a right side front angled corner edge 114 and a right side rear angled corner edge 116, and the left side interior flap 64 has a left side front angled corner edge 118 and a left side rear angled corner edge 120. In addition, the front panel 44 has a right side angled corner edge 122 and a left side angled corner edge 124 that are sized and shaped to butt against the right side front angled corner edge 114 and the left side front angled corner edge 118, respectively, in response to the top panel 30 being folded over the middle panel 68.

Preferably the right side front angled corner edge 114 and the left side front angled corner edge 118 on the right side and left side interior flaps 62, 64, respectively, and the right side angled corner edge 122 and the left side angled corner edge 124 on the front panel 44 are all formed at a 45 degree angle to the bottom front bend line 46. In addition, the right side rear angled corner edge 116 and the left side rear angled corner edge 120 on the right side and left side interior flaps 62, 64, respectively, are formed at a 45-degree angle to the bottom rear bend line 56.

Moreover, the rear panel flap 48 has a right side top angled corner edge 126 and a left side top angled corner edge 128 that are sized and shaped to butt against the right side rear angled corner edge and the left side rear angled corner edge, respectively, when the top panel 30 is folded over the middle panel 68. Ideally, the right side top angled corner edge 126 and the left side top angled corner edge 128 are formed at a 45-degree angle to the right bend line 36 and the left bend line 38, respectively.

To further enhance the strength and flatness of the sides of the carrier 20 in the folded configuration, the right side interior flap 62 has a right side interior corner 127 adjacent the right side angled corner edge 114 and the left side interior flap 64 has a left side interior corner 129 adjacent the left side front angled corner edge 118. In addition, the front panel 44 has a right side exterior corner 130 adjacent the right side angled corner edge 122 and a left side exterior corner 132 adjacent the left side angle corner edge 124 that are sized and shaped to fit within the right side interior corner 127 and the left side interior corner 129, respectively, when the top panel 30 is folded over the middle panel 68 to facilitate holding the foldable carrier 20 in the folded configuration shown in FIG. 4.

In addition to the foregoing, the right side interior flap 62 has a right side rear interior corner 134 adjacent the right side rear angled corner edge 116, and the left side interior flap 64 has a left side rear interior corner 136 adjacent the left side rear angled corner edge 120. Further, the rear panel flap 48 has a right side top exterior corner 138 adjacent the right side top angled corner edge 126 and a left side top exterior corner 140 adjacent the left side top angled corner edge 128. The right side top exterior corner 138 and the left side top exterior corner 140 are sized and shaped to fit within the right side rear interior corner 134 and the left side rear interior corner 136 when the top panel 30 is folded over the middle panel 68.

As shown in FIG. 1, the right side top exterior corner 138 on the rear panel flap 48 forms a 135-degree angle with the adjacent right side top angled corner edge 126, and the left side top exterior corner 140 forms a 135 degree angle with the adjacent left side top angled corner edge 128. In addition, the right side exterior corner 130 on the front panel 44 forms a 135-degree angle with the adjacent right side angled corner edge 122, and the left side exterior corner 132 on the front panel 44 forms a 135-degree angle with the adjacent left side angled corner edge 124.

In one implementation of the carrier 20, each opening 40 in the plurality of drink cup openings 40 in the top panel 30 includes at least one bendable tab 142 extending from the top panel 30 into the opening 40. As shown, there are four bendable tabs 42 spaced equidistantly around the circumference of the opening 40. The tabs 40 are sized and shaped to frictionally engage the drink cup 22 when the drink cup 22 is inserted into the opening 40.

The right side support flap 84 and the left side support flap 86 on the middle panel 68 each have a cut-out 146, 148, respectively, that is formed along the outer edge of the flap 84, 86. These cutouts are sized and shaped to permit the right side tab 100 and left side tab 102 to be inserted past the respective right side support flap 84 and left side support flap 86 after the top panel 30 has been folded over the middle panel 68.

FIGS. 2-3 show top plan views of the unfolded eight-cup drink cup carrier 26 and the twelve-cup drink cup carrier 28, respectively. Identical or highly similar features are shown with the same reference numbers used for the four-cup foldable drink cup carrier 20.

Shown in FIGS. 4-6 are the three different carriers 20, 26, 28 in the folded configuration. The steps to fold the carriers 20, 26, 28 into the folded configuration are essentially the same and will be described and illustrated with respect to the eight-cup foldable drink cup carrier 26.

Figure 7:
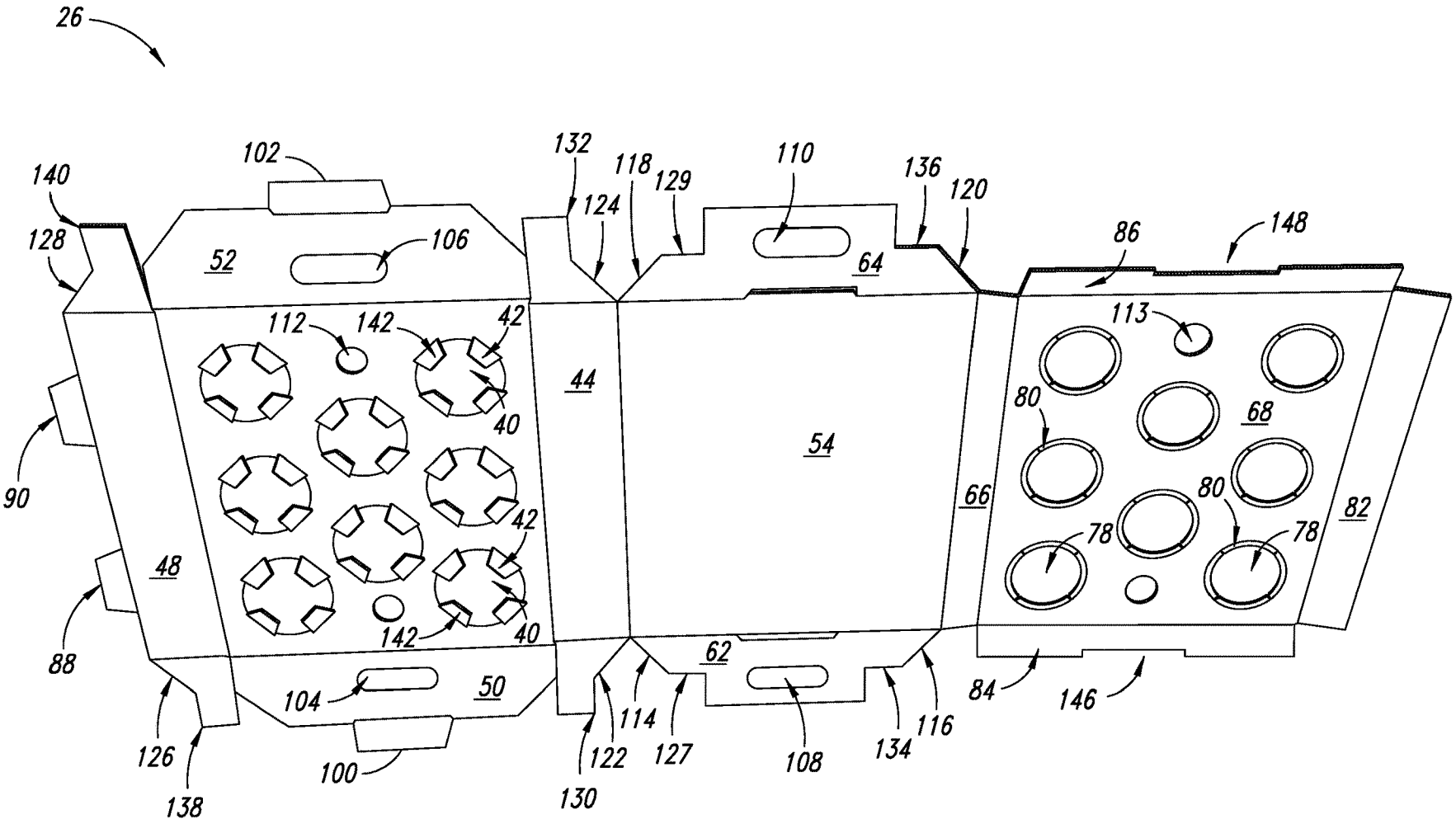
FIG. 7 is a top plan view of the eight-cup foldable drink cup carrier in the unfolded configuration.
Figure 8:
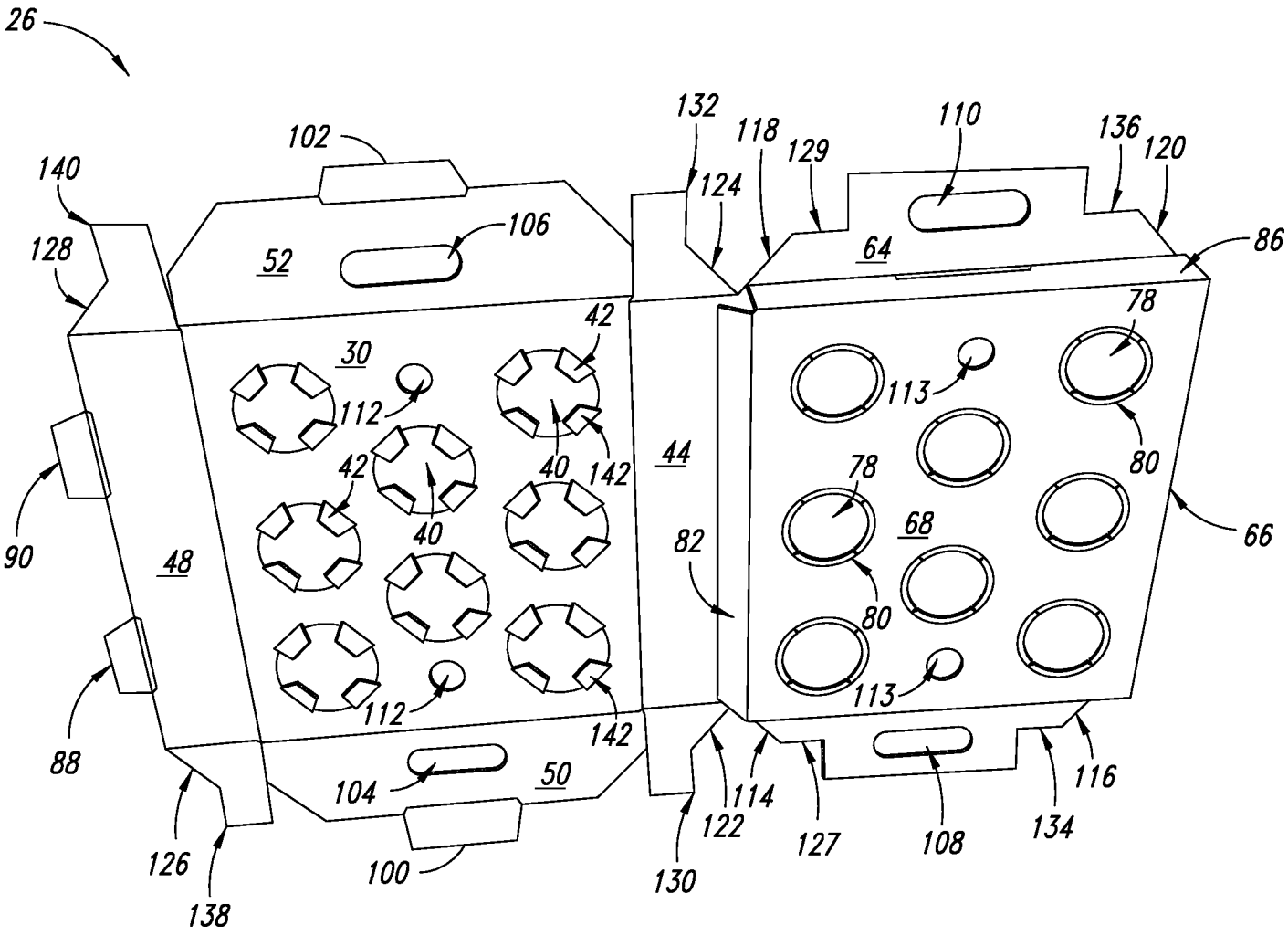
FIG. 8 is an illustration of the middle panel folded over the bottom panel.

As shown in FIG. 7, the carrier 26 is shown in the flattened, unfolded configuration. In FIG. 8, the middle panel 68 is folded at the bend lines to be over the bottom panel 54. The three flaps 82, 84, 86 will support the middle panel 68 on the bottom panel 54 when the flaps 82, 84, 86 are bent at substantially a right angle so the flaps 82, 84, 86 are orthogonal to the middle panel 68 and the bottom panel 54.

Figure 9:
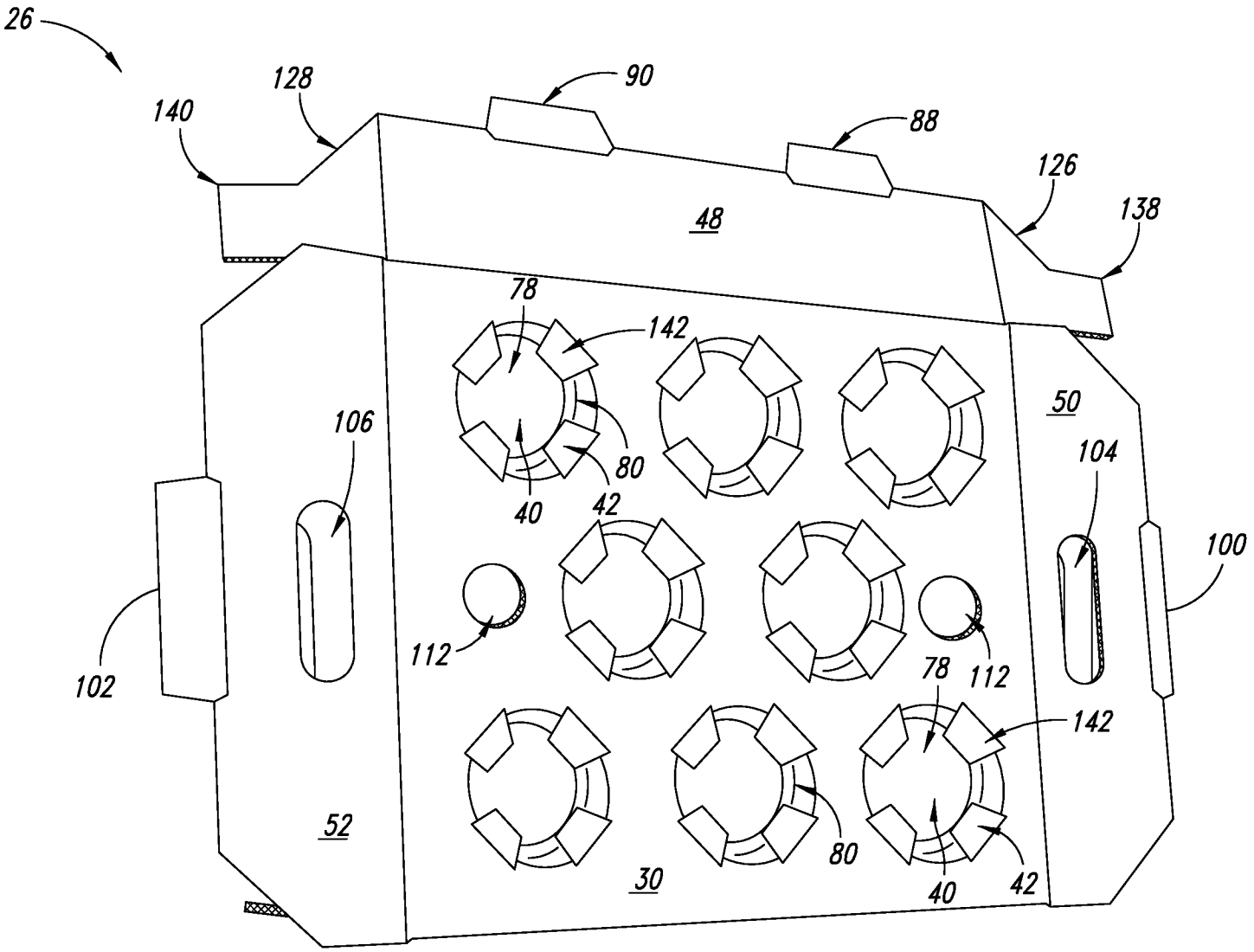
FIG. 9 is an illustration of the top panel folded over the middle panel.

In FIG. 9, the top panel 30 is folded about the bend lines to be positioned over the middle panel 68 so that the drink cup openings 40 in the top panel are in concentric alignment with the openings 78 in the middle panel, as shown.

Figure 10:
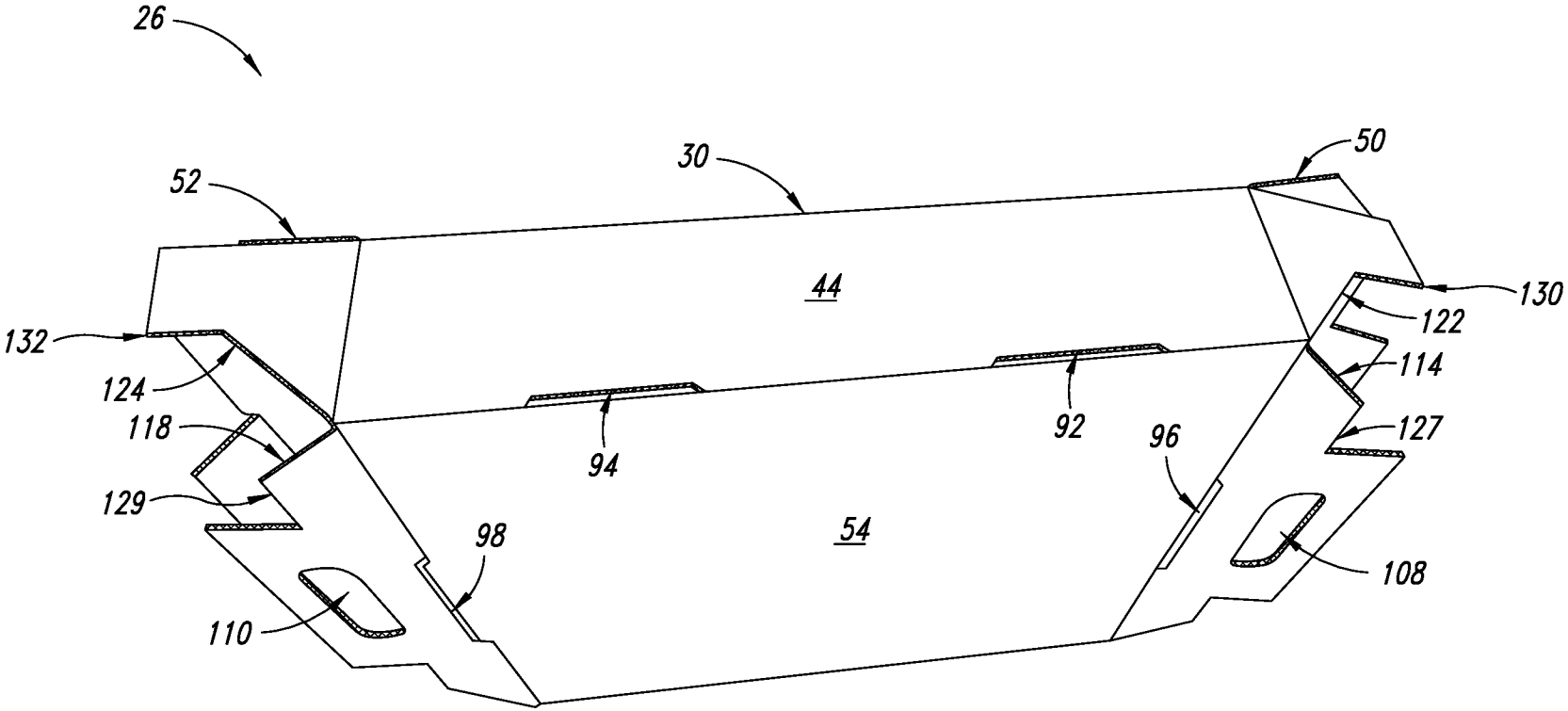
FIG. 10 is an illustration of the side tabs inserted into the slit in the interior flap.
Figure 11:
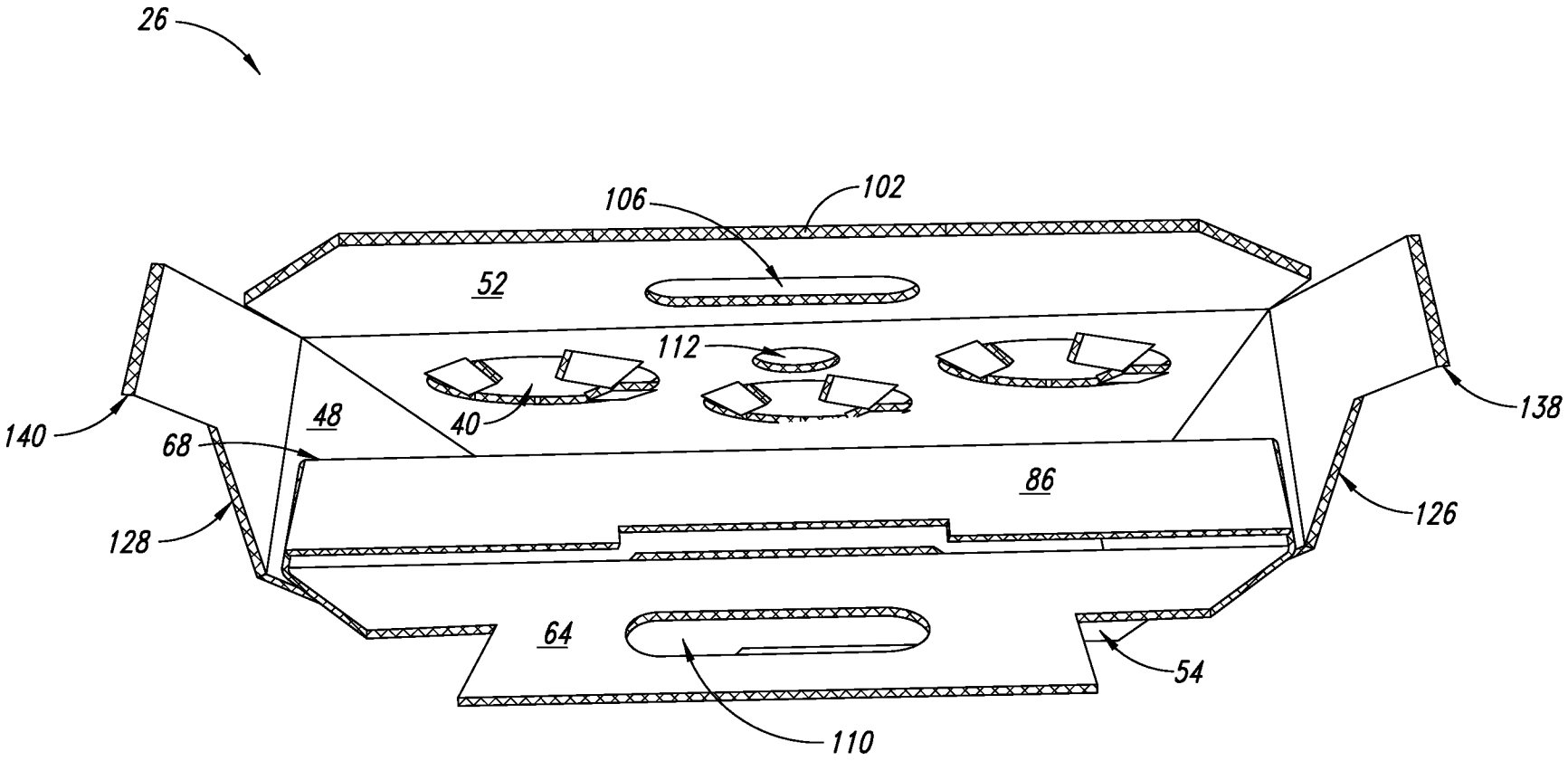
FIG. 11 is an illustration of an open end of the carrier.

In FIG. 10, the rear panel flap 44 is folded about the rear bend line 34 to be orthogonal to the bottom panel 54. The right and left back tabs 88, 90, are inserted into the slits 92, 94, respectively to hold the top panel 30 in place. The ends of the carrier 20 are open, as shown in FIG. 11, where the middle panel 68 is supported on the bottom panel 54.

Figure 12:
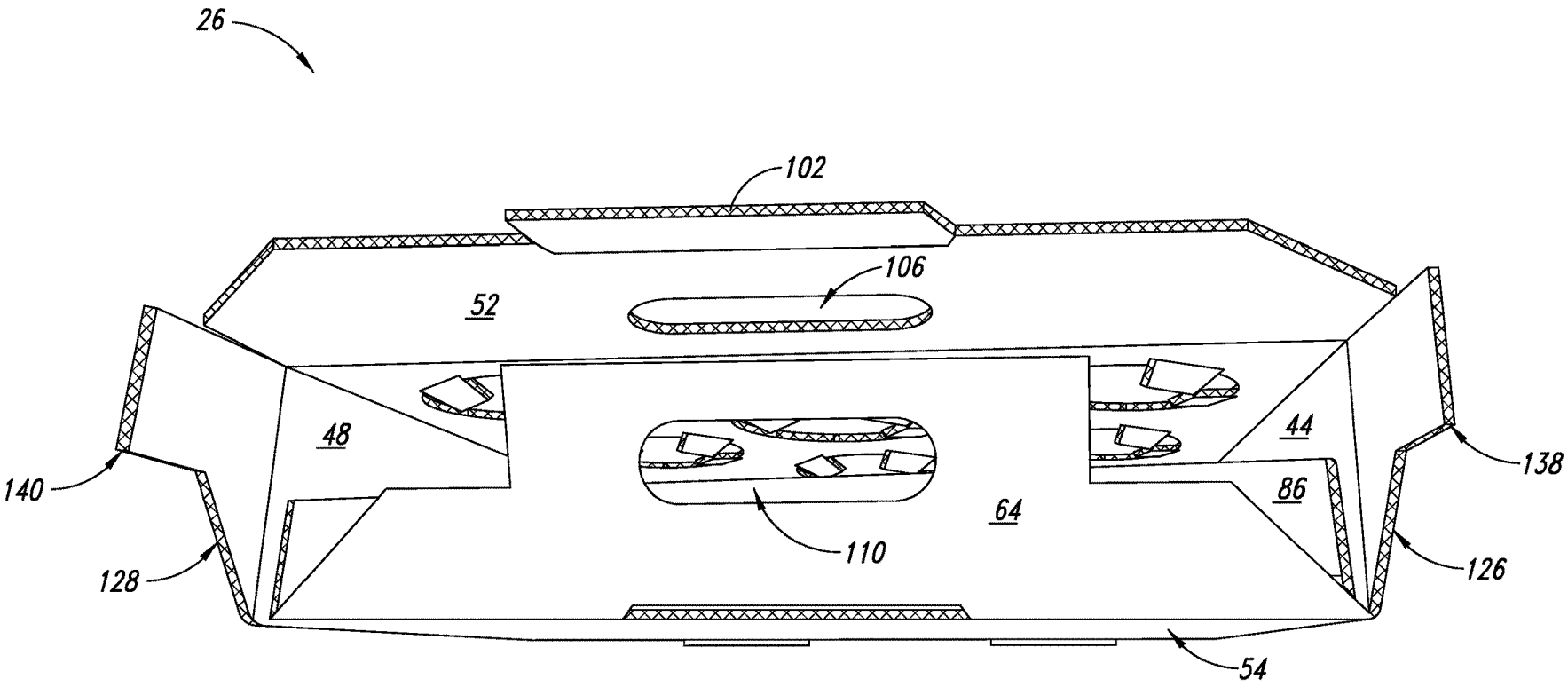
FIG. 12 is an illustration of a first step of partially closing the end of the carrier.
Figure 13:
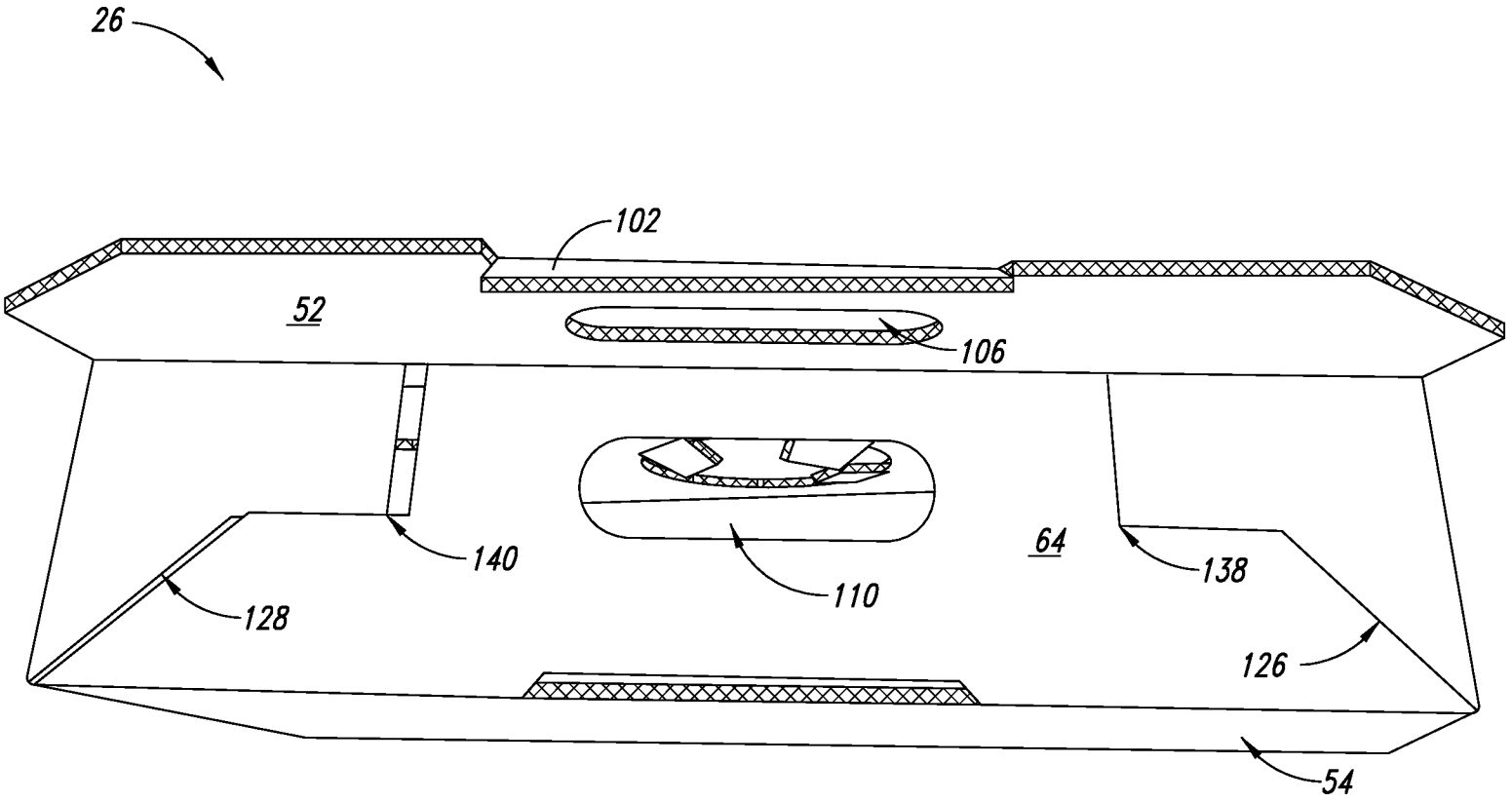
FIG. 13 is an illustration of a second step of partially closing the end of the carrier.
Figure 14:
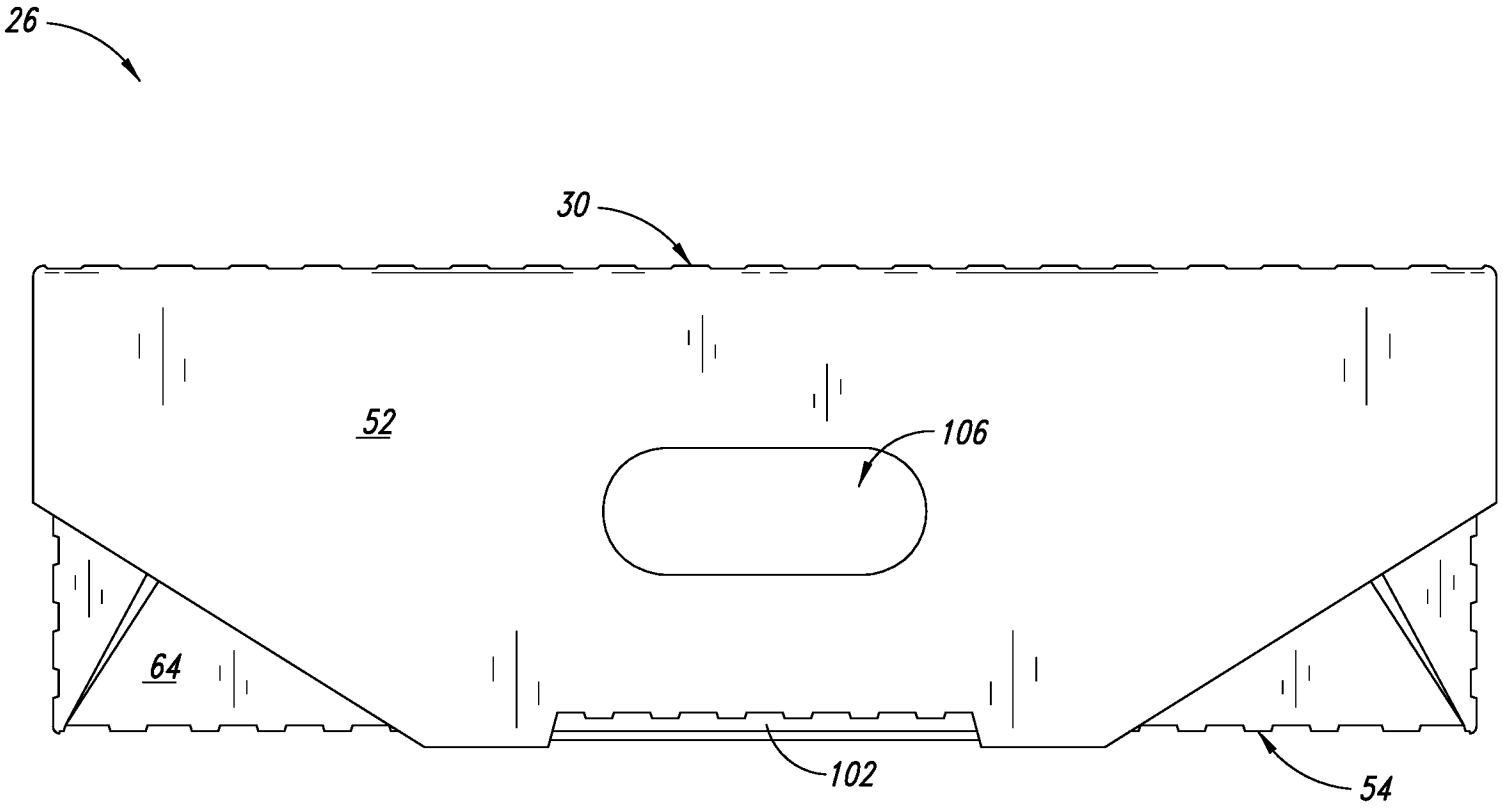
FIG. 14 is an illustration of a final step of closing the end is shown in the end of the carrier.

Next, the left side interior flap 64 is folded over to be orthogonal to the bottom panel 54 as shown in FIG. 12. The right and left sides of the front panel 44 and rear panel flap 48 are then folded over so the left side top angled corner edge 128 butts against the left side angled corner edge 120, and the right side top angled corner edge 126 butts against the right side rear angled corner edge 116, which is shown in FIG. 13. In addition, the right side top exterior corner 138 nests inside the right side rear interior corner 134, while the left side top exterior corner 140 nests inside the left side rear internal corner 136, again as shown in FIG. 13. The left side exterior flap 52 is then folded over to be orthogonal to the top panel 30 and bottom panel 54 and secured in place by sliding the left side tab 102 into the slit 98, as shown in FIG. 14.

The opposite end of the carrier 20 is folded and secured in the same fashion to achieve the folded configuration of the eight-cup foldable drink cup carrier 26 shown in FIG. 5. These same steps apply to the four-cup carrier 20 and twelve-cup carrier 28.

The various implementations described above can be combined to provide further implementations. Aspects of the implementations can be modified, if necessary to employ concepts of the various patents, applications and publications to provide yet further implementations.

These and other changes can be made to the implementations in light of the above-detailed description. In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

The invention claimed is:

1. A foldable carrier for drink cups, the carrier comprising:

a single sheet of foldable material comprising:

a top panel having a front bend line, a rear bend line, a right bend line, and a left bend line, the top panel having a plurality of drink cup openings;

a front panel extending from the front bend line on the top panel;

a rear panel flap extending from the rear bend line on the top panel;

a right side exterior flap extending from the right bend line on the top panel;

a left side exterior flap extending from the left bend line on the top panel;

a bottom panel having a bottom front bend line, a bottom rear bend line, a bottom right bend line, and a bottom left bend line, the bottom panel extending from the front panel at the bottom front bend line;

a right side interior flap extending from the bottom right bend line on the bottom panel;

a left side interior flap extending from the bottom left bend line on the bottom panel;

a rear support panel extending from the bottom rear bend line on the bottom panel;

a middle panel having a middle front bend line, a middle rear bend line, a middle right side bend line, and a middle left side bend line, the middle panel extending from the rear support panel at the middle front bend line, the middle panel having a plurality of drink cup openings;

a front support flap extending from the middle rear bend line on the middle panel;

a right side support flap extending from the middle right side bend line on the middle panel;

a left side support flap extending from the middle left side bend line on the middle panel; and the middle panel structured to fold over the bottom panel in a folded over configuration and be supported at a middle level on the bottom panel by the front support flap, the rear support panel, the right side support flap, and the left side support flap; and the top panel structured to fold over the middle panel and be supported on the bottom panel at a top level above the middle level of the middle panel by the front panel, the rear panel flap, the right side exterior flap, and the left side exterior flap, to place the foldable carrier in a folded configuration in which the plurality of drink cup openings in the top panel are positioned in concentric alignment with the plurality of drink cup openings in the middle panel.

2. The foldable carrier of claim 1 further comprising a right back tab extending from the rear panel flap, a left back tab extending from the rear panel flap, a right back tab slit formed in the bottom rear bend line, and a left back tab slit formed in the bottom rear bend line, the left back tab and right back tab sized and shaped to be slidably received in the right back tab slit and left back tab slit, respectively, to hold the top panel in place and the foldable carrier in the folded configuration.

3. The foldable carrier of claim 1 further comprising a left side tab slit formed in the bottom left bend line on the bottom panel, a right side tab slit formed in the bottom right bend line on the bottom panel, a left side tab extending from the left side exterior flap on the top panel, and a right side tab extending from the right side exterior flap, the left side tab and right side tab sized and shaped to be slidably received in the left side tab slit and the right side tab slit, respectively, to hold the top panel in place and hold the foldable carrier in the folded configuration.

4. The foldable carrier of claim 1 further comprising a top right hand hold opening formed in the right side exterior flap, a top left hand hold opening formed in the left side exterior flap, a right side hand hold opening formed in the right side interior flap, a left side hand hold opening formed in the left side interior flap, the top right hand hold opening and the right side hand hold opening structured to overlap and the top left hand hold opening and the left side hand hold opening structured to overlap when the top panel is folded over the middle panel and the foldable carrier is in the folded configuration.

5. The foldable carrier of claim 1 further comprising at least one opening in the top panel and at least one corresponding opening in the middle panel that are structured to be concentric when the top panel is in the folded configuration, the at least one opening in the top panel and the at least one corresponding opening the middle panel sized and shaped to accommodate a plurality of straws corresponding in number to a number of the plurality of drink cup openings in the top panel.

6. The foldable carrier of claim 1 wherein the right side interior flap has a right side front angled corner edge and a right side rear angled corner edge, and the left side interior flap has a left side front angled corner edge and a left side rear angled corner edge, and further wherein the front panel has a right side angled corner edge and a left side angled corner edge that are sized and shaped to butt against the right side front angled corner edge and the left side front angled corner edge, respectively, in response to the top panel being folded over the middle panel.

7. The foldable carrier of claim 6 wherein the right side front angled corner edge and the left side front angled corner edge on the right side and left side interior flaps, respectively, and the right side angled corner edge and the left side angled corner edge on the front panel are all formed at a 45-degree angle to the bottom front bend line, and the right side rear angled corner edge and the left side rear angled corner edge on the right side and left side interior flaps, respectively, are formed at a 45-degree angle to the bottom rear bend line.

8. The foldable carrier of claim 6 wherein the rear panel flap has a right side top angled corner edge and a left side top angled corner edge that are sized and shaped to butt against the right side rear angled corner edge and the left side rear angled corner edge, respectively, when the top panel is folded over the middle panel.

9. The foldable carrier of claim 8 wherein the right side top angled corner edge and the left side top angled corner edge are formed at a 45-degree angle to the right bend line and the left bend line, respectively.

10. The foldable carrier of claim 8 wherein a right side interior flap has a right side interior corner adjacent the right side front angled corner edge and a left side internal flap has a left side interior corner adjacent the left side front angled corner edge, and further wherein the front panel has a right side exterior corner adjacent the right side angled corner edge and a left side exterior corner adjacent the left side angled corner edge that are sized and shaped to fit within the right side interior corner and left side interior corner, respectively, when the top panel is folded over the middle panel.

11. The foldable carrier of claim 10 wherein the right side interior flap has a right side rear interior corner adjacent the right side rear angled corner edge and the left side interior flap has a left side rear interior corner adjacent the left side rear angled corner edge, and further wherein the rear panel flap has a right side top exterior corner adjacent the right side top angled corner edge and a left side top exterior corner adjacent the left side top angled corner edge, the right side top exterior corner and the left side top exterior corner are sized and shaped to fit within the right side rear interior corner and the left side rear interior corner when the top panel is folded over the middle panel and the foldable carrier is in the folded configuration.

12. The foldable carrier of claim 11 wherein the right side top exterior corner on the rear panel flap forms a 135-degree angle with the adjacent right side top angled corner edge and the left side top exterior corner forms a 135-degree angle with the adjacent left side top angled corner edge, and further wherein the right side exterior corner on the front panel forms a 135-degree angle with the adjacent right side angled corner edge, and the left side exterior corner on the front panel forms a 135-degree angle with the adjacent left side angled corner edge.

13. The foldable carrier of claim 1 wherein each opening in the plurality of drink cup openings in the top panel includes at least one bendable tab extending from the top panel into the opening, the at least one bendable tab sized and shaped to frictionally engage the drink cup.

14. The foldable carrier of claim 1 wherein each opening in the plurality of drink cup openings in the middle panel comprise at least one bendable arcuate tab extending from the middle panel into the opening, the at least one bendable arcuate tab sized and shaped to frictionally engage the drink cup.

* * * * *